United States Patent [19]

de la Fuente, Jr.

[11] 4,151,948

[45] May 1, 1979

[54] STACKABLE CONTAINER

[75] Inventor: Carlos de la Fuente, Jr., Corona, Calif.

[73] Assignee: Container Corporation of America, Chicago, Ill.

[21] Appl. No.: 887,495

[22] Filed: Mar. 17, 1978

[51] Int. Cl.[2] ..... B65D 5/22

[52] U.S. Cl. ..... 229/34 R

[58] Field of Search ..... 229/34 R, 34 HW, DIG. 11

[56] References Cited

U.S. PATENT DOCUMENTS

| | | | |
|---|---|---|---|
| 2,934,250 | 4/1960 | Stolz | 229/34 R X |
| 2,986,320 | 5/1961 | Nicholls et al. | 229/34 R X |
| 3,375,967 | 4/1968 | Robinson | 229/34 R |
| 3,533,547 | 10/1970 | Houston | 229/34 R |
| 3,820,706 | 6/1974 | Gibson et al. | 229/34 R |

FOREIGN PATENT DOCUMENTS

| | | | |
|---|---|---|---|
| 1232518 | 4/1960 | France | 229/DIG. 11 |
| 2261943 | 2/1974 | France | 229/DIG. 11 |
| 799792 | 8/1958 | United Kingdom | 229/DIG. 11 |

*Primary Examiner*—Davis T. Moorhead

*Attorney, Agent, or Firm*—Carpenter & Ostis

[57] ABSTRACT

An open top, tray type container having a corner construction adapted to accommodate interlocking stacking with similar containers.

4 Claims, 7 Drawing Figures

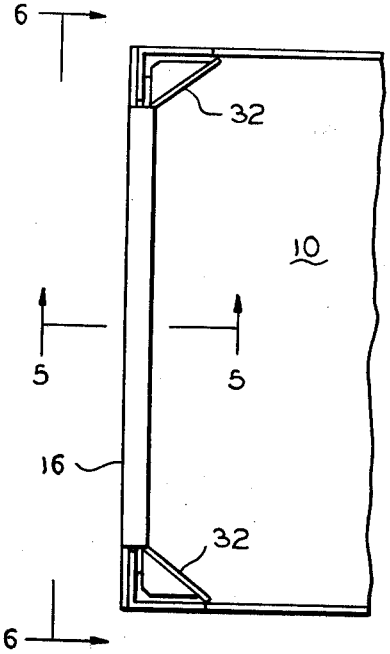
FIG.4
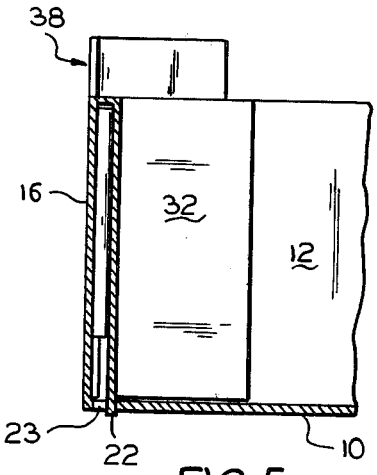
FIG.5
FIG.6
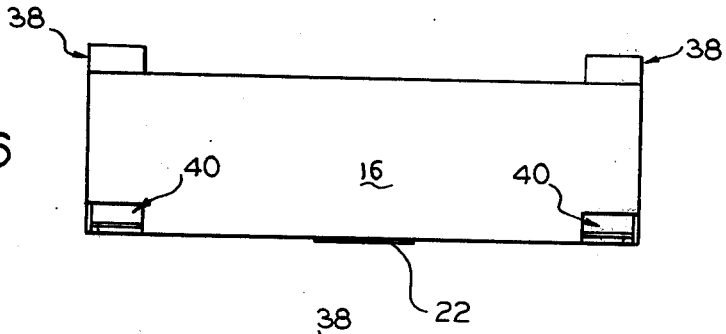
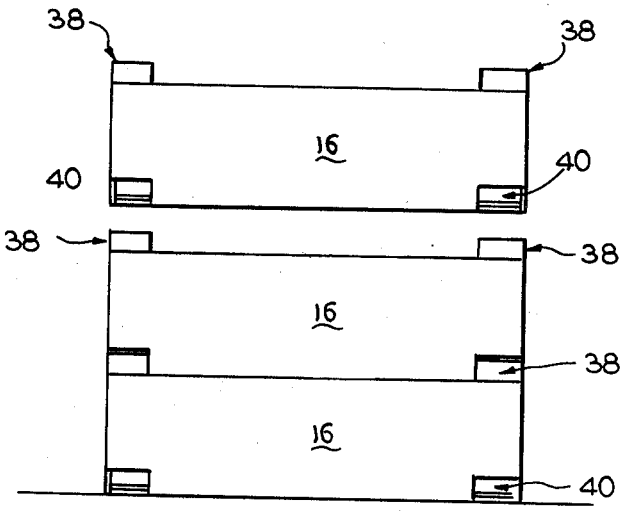
FIG.7

STACKABLE CONTAINER

SUMMARY OF THE INVENTION

This invention relates to open top tray type containers of the type utilized in the produce and other industries, and particularly to containers having structural features accommodating the vertical stacking of similar containers.

It is an object of the invention to provide, in a container of the type described, integral corner posts and projections adapted to mate with related openings in similar trays to accommodate vertical stacking of similar containers.

A more specific object of the invention is to provide, in a container of the type described, a one piece structure wherein the end walls have portions which provide corner posts and stacking projections at the corners of the container.

These and other objects of the invention will be apparent from an examination of the following description and drawings.

THE DRAWINGS

FIG. 4 is a fragmentary plan view of the structure illustrated in FIG. 1;

FIG. 5 is a fragmentary, longitudinal vertical section taken on line 5—5 of FIG. 4;

FIG. 6 is an end elevation taken on line 6—6 of the structure illustrated in FIG. 4; and FIG. 7 is a fragmentary end elevation illustrating the manner in which similar containers embodying the invention may be vertically stacked one upon the other in interlocking relation.

It will be understood that, for purposes of clarity, certain elements may have been intentionally omitted from certain views where they are believed to be illustrated to better advantage in other views.

THE DESCRIPTION

Figure 3:
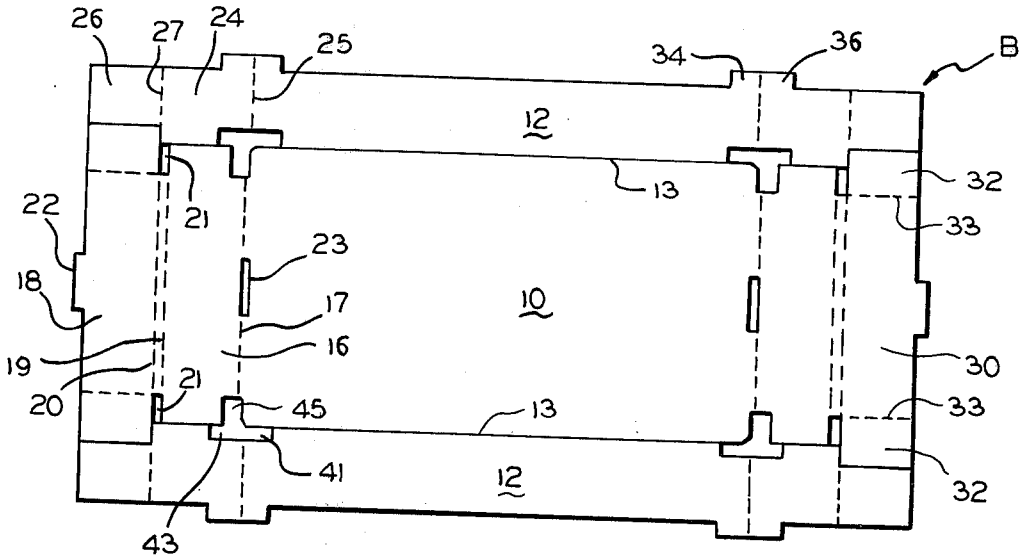
FIG. 3 is a plan view of a blank of sheet material from which the container illustrated in the other views may be formed.
Figure 2:
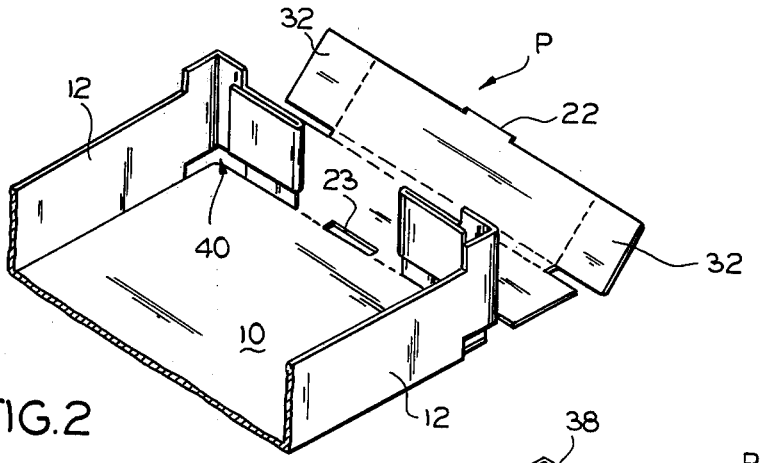
FIG. 2 is a view similar to FIG. 1 but illustrating the manner in which the end walls of the container are erected.
Figure 1:
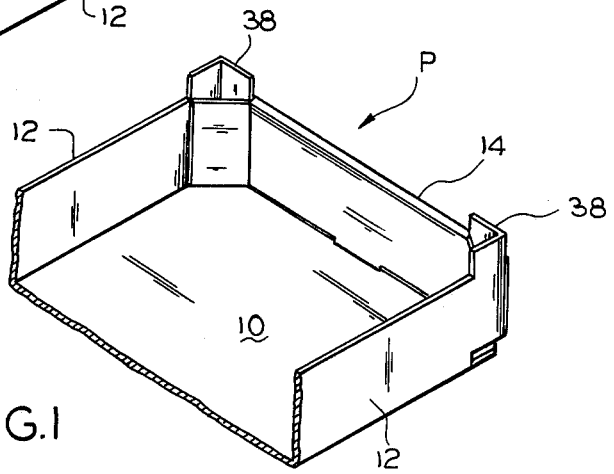
FIG. 1 is a fragmentary perspective view of a portion of an erected container embodying features of the invention.

Referring now to the drawings for a better understanding of the invention, it will be seen that the novel tray type container, indicated generally at P, which embodies features of the invention, may be formed from a unitary blank B of foldable sheet material, as illustrated in FIG. 3.

The container includes a preferably rectangular bottom wall 10 having opposed pairs of side and end walls 12 and 14, respectively, foldably joined to opposed side and end edges of the bottom wall and upstanding therefrom to form a tray like structure.

The structure includes corner posts with portions projecting upwardly upon the upper edges of the side and end walls, and has corner openings at the bottom thereof for receiving projections of related tray to provide interlocking engagement when the containers are stacked with each other. Each of the side walls 12 includes a single panel foldably joined at its lower edge along fold line 13 to a related side edge of bottom wall 10.

Each of the end walls 14 includes an outer panel 16 foldably joined at its lower edge along fold line 17 to a related end edge of bottom wall 10. Each end wall also includes an inner panel 18 foldably joined at its upper edge to the upper edge of related outer panel 16 by at least one fold line 19. Preferably in order to accommodate the added thickness, there may be provided a pair of fold lines 19 which define a relatively narrow upper hinge strip 20 therebetween which connects the inner and outer panels to each other.

Inner panel 18 may be provided at its lower edge with a projection 22 which is disposed to be received within a slot 23 adjacent the related end edge of bottom wall 10 to provide a "Walker-lock" type connection therebetween. At each end of each side wall 12 there is provided a pair of first end flaps 24 foldably joined to the end edges of side wall panel 12 along fold lines 25 and a pair of second end flaps 26 which are foldably joined along fold lines 27 to the adjacent edges of first end flaps 24.

In forming the carton, the first and second end flaps are folded in face to face relation and at right angles to their related side wall panels 12, and are then sandwiched between marginal portions of the end wall inner and outer panels to provide a means of interconnecting the side and end walls at each corner of the tray.

Each of the end wall inner panels 18 includes a center portion 30 having a pair of side portions 32 foldably joined to opposed side edges thereof along fold lines 33.

It will be noted that the combined length of center portion 30 and side portions 32 is greater than the length of outer panel 16 so that when the inner and outer panels are folded together in face to face relation, with the side wall end flaps sandwiched therebetween, the side portions 32 of each end wall inner panel 18 are disposed to extend diagonally across the corners of the container from the side edges of the inner panel center portion 30 to the inside surfaces of adjacent portions of related side wall panels 12 in order to form reinforcing integral corner post structures.

It will be noted that the side wall panels 12 are provided at opposite ends thereof with projections 34 which extend above the level of the upper edges of the side wall panels and also that side wall first end flaps 24 are also provided with projections 36 which also extend above the level of the upper edge of the end wall, through related openings 21 formed in hinge strip 20. Thus, it will be appreciated that at each corner of the container the projections 34 and 36 combine to provide an L-shaped corner projection or stack tab 38 which is adapted to be received within a related corner opening 40 located at the bottom of a similar container.

Each of the openings 40 is formed by portions 41, 43 and 45 which are cut from material of side wall panel 12, first end flap 24, and outer end panel 16, respectively.

Thus, it will be appreciated that the invention provides a one piece, tray type container having integral corner posts and stacking tabs which are formed without requiring any additional material or setup labor because they are an integral part of the tray structure and are formed automatically as the tray is erected.

I claim:

1. An open top, tray type container, formed of an unitary blank of foldable paperboard, and having a corner construction adapted to accommodate interlocking stacking with similar containers, comprising:

(a) a bottom wall having opposed pairs of side and end walls foldably joined to opposed side and end edges thereof and upstanding therefrom to form a tray like structure;

(b) said structure including corner posts with portions projecting upwardly beyond the upper edges of the side and end walls and having corner openings at the bottom thereof for interlocking engagement with openings and posts of similar trays when stacked vertically therewith;

(c) said side walls each comprising a single side wall panel having projections extending upwardly at each end thereof which form portions of said corner posts;

(d) said end walls each comprising:

(i) an outer panel foldably joined at its lower edge to a related end edge of said bottom wall;

(ii) projections extending upwardly at each side thereof which form portions of said corner posts;

(iii) an inner panel foldably joined at its upper edge to an upper edge of said outer panel and extending downwardly to said bottom wall;

(iv) said inner panel including a center section disposed in parallel relation with said outer panel and a pair of end sections, foldably joined to opposite side edges of said center section, and disposed to extend diagonally from said end wall to said side wall to form other portions of said corner posts.

2. A container according to claim 1, wherein the upper edges of each of said end wall outer and inner panels are foldably connected to each other by a relatively narrow, elongated hinge strip.

3. A container according to claim 1, wherein said end wall includes end flaps foldably joined to adjacent end edges of related side walls and interposed between the inner and outer panels of said end wall.

4. A container according to claim 1, wherein said end wall each include:

(a) end flaps foldably joined to adjacent end edges of related side walls and interposed between the inner and outer panels of said end wall;

(b) a relatively narrow, elongated hinge strip foldably joined at its opposed side edges to upper edges of related inner and outer panels, (c) said end flaps including said end wall projections;

(d) said hinge strip having at opposite ends thereof openings through which said projections extend.

* * * * *